US005895280A

United States Patent [19]

Buss et al.

[11] Patent Number: 5,895,280

[45] Date of Patent: Apr. 20, 1999

[54] ELECTRICAL PLUG-AND-SOCKET CONNECTOR FOR CONDUCTIVE FOILS

[75] Inventors: Heiko Buss, El Paso, Tex.; Ralph Schimitzek, Obersulm/sulzbach, Germany

[73] Assignee: Robert Bosch GmbH, Stuttgart, Germany

[21] Appl. No.: 08/800,433

[22] Filed: Feb. 18, 1997

[30] Foreign Application Priority Data

Feb. 29, 1996 [DE] Germany ..... 296 03 678 U

[51] Int. Cl.[6] ..... H01R 13/52

[52] U.S. Cl. ..... 439/271; 439/495

[58] Field of Search ..... 439/271, 274, 439/275, 875, 917, 495, 496, 499

[56] References Cited

U.S. PATENT DOCUMENTS

| | | | |
|---|---|---|---|
| 3,366,919 | 1/1968 | Gammel, Sr. et al. | 439/495 OR |
| 4,188,086 | 2/1980 | Inouye et al. | 439/496 OR |
| 4,713,020 | 12/1987 | Awano et al. | 439/495 X |
| 5,110,305 | 5/1992 | Edgley et al. | 439/495 X |
| 5,324,207 | 6/1994 | Itoh et al. | 439/271 X |

FOREIGN PATENT DOCUMENTS

| | | |
|---|---|---|
| 0 214 830 | 3/1987 | European Pat. Off. . |

*Primary Examiner*—P. Austin Bradley
*Assistant Examiner*—Daniel Wittels
*Attorney, Agent, or Firm*—Kenyon & Kenyon

[57] ABSTRACT

An electrical plug-and-socket connector for conductive foils is designed so that it continues to operate reliably long-term under rough operating conditions. For this purpose, the plug-and-socket connector has a plug that can be assembled from a top part and a bottom part with the conductive foil glued into the plug and therefore sealed between these parts when the top part and the bottom part are joined. Furthermore, a sealing element is mounted peripherally on the plug, which is in close elastic contact with a peripheral sealing surface of the socket when the plug is inserted in a socket, and seals the joint between plug and socket. The electrical plug-and-socket connector for conductive foils is intended particularly for use in automobiles.

11 Claims, 1 Drawing Sheet

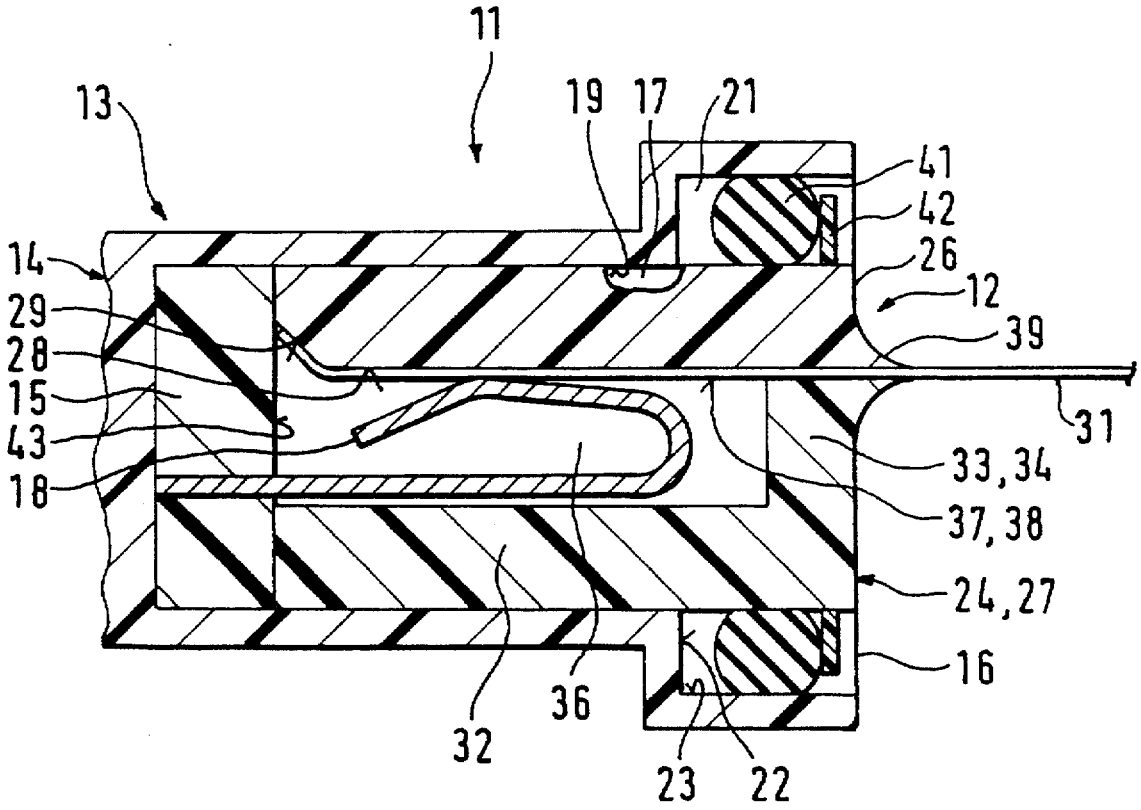
11
13
19
17
21
41
42
26
12
39
14
29
28
15
43
18
31
33,34
37,38
24,27
16
36
32
23
22

ELECTRICAL PLUG-AND-SOCKET CONNECTOR FOR CONDUCTIVE FOILS

BACKGROUND INFORMATION

A plug-and-socket connection is described in European Patent Application No. 214,830 A2. This plug-and-socket connector has a socket with a box-shaped socket housing, which is enclosed on all sides up to an inlet opening to an insertion area for a plug. The plug is formed from a plate-type support element for the conductive foil that is in close contact with the support element on the outside; the support element is bent in a wedge shape and can be elastically pressed together.

When the support element is pressed together, it can be inserted in the insertion area of the socket housing, in which case contact elements of the socket make electrical contact with strip-shaped terminals of the conductive foil.

Such an enclosed plug-and-socket connector secured on the support element and on the socket housing in its end position via locking elements has, however, gaps due to the tolerance between inlet opening and support element through which media such as moisture and dust can penetrate in the socket insertion area and there can corrode the terminal contact elements.

Such a plug-and-socket connector is subject to failure, especially under rough operating conditions and is not reliable in the long run.

SUMMARY OF THE INVENTION

The electrical plug-and-socket connector for conductive foils according to the present invention has the advantage that the aforementioned inconvenience is eliminated to a satisfactory degree. For this purpose, the conductive foil is tightly enclosed by a plug housing of the plug on the one hand and, on the other hand, a sealing element is applied externally around the plug housing, which is in close elastic contact with a sealing surface of the socket housing when the plug-and-socket connector is established. Thus, both the junction between plug and socket and the insertion of the conductive foil in the plug are sealed and the plug-and-socket connector is protected from media, so that the plug-and-socket connection remains corrosion free and will operate reliably even under rough operating conditions.

BRIEF DESCRIPTION OF THE DRAWINGS

The FIGURE shows a longitudinal section through the plug-and-socket connector according to the present invention.

DETAILED DESCRIPTION

A plug-and-socket connector 11 schematically illustrated in the FIGURE comprises a plug 12 that can be reversibly inserted in socket 13. Socket 13 can be firmly attached to a machine in a manner that is not illustrated in detail, and plug 12 can be mounted to the end of a movable electric conductor.

Socket 13 has a box-like socket housing 14 made of plastic, which is enclosed up to an inlet opening 16 to an insertion area 17 for plug 12. Strip-shaped contact elements 18, bent in a U shape and oriented in the direction of insertion of plug 12, are arranged in a row and supported by a contact support 15 in insertion area 17.

Insertion area 17, limited by an inner wall 19, widens toward inlet opening 16 in steps, forming a receiving area

21, which is limited peripherally as a part of inlet opening 16 by shoulder 22 oriented across the direction of insertion on the one hand and by a sealing surface 23 running in the direction of insertion on the other hand.

Plug 12 has a plug housing 24 made of plastic, which can be assembled from a plate-shaped top part 26 and an angle-shaped bottom part 27.

Top part 26 is provided with a bezel 29 at the end of its bottom 28. The front end of a thin-walled, layer-shaped conductive foil 31 is guided along bottom 28 starting at bezel 29 and is attached by gluing.

Angle-shaped bottom part 27 has a baseplate 32 with the same basic dimensions of top part 26, which has a parallel piped-shaped attachment 33 at the end.

To join plug housing 24, attachment 33 is provided with glue on the front, and the mating part of bottom 28 is butt-joined and cured so that the rear end of top part 26 ends flush with attachment 33 and baseplate 32, So that a pass-through rear wall 34 of plug housing 24 is formed with attachment 33 as central part, which rear wall is traversed by conductive foil 31 sealed with the glue.

Thus a contact area 36, whose height corresponds to that of attachment 33, is formed between the unattached bottom 28 extending from bezel 29 to attachment 33 and the opposite bottom part 27.

Alternatively, a plug housing 24 so designed can also be manufactured from a single piece using a plastic injection molding process or a foam molding process, for example, with curable polyurethane foam.

Conductive foil 31 is designed as a flexible conductive foil in which strip-shaped electric conductors 37, running parallel to one another, are insulated between plastic films glued together. Conductors 37 are freed from the plastic film facing bottom part 27 in contact area 36, so that conductors 37 form bare metallic terminals 38, uninsulated on one side, of conductive foil 31 here.

As it exits from plug housing 24, conductive foil 31 is surrounded by attachment 39 mounted on rear wall 34; the flexibility of said attachment increases with the distance from rear wall 34 as it becomes continuously narrower and makes a transition possible from rigid to flexible connection of conductive foil 31 to plug housing 24 after its exit from rear wall 34. Thus the exit of conductive foil 31 from rear wall 34 is sealed further in addition to its gluing in plug housing 24 via attachment 39.

A sealing element 41 in the form of a prestressed O-ring is supported in a manner not illustrated in detail on plug 12, in a plane perpendicular to conductive foil 31, and axially secured to rear wall 34 via a peripheral stop 42.

To establish the plug-and-socket connection, plug 12, which has a basically rectangular cross section with rounded corners, is guided into insertion area 17 in the direction of insertion along conductive foil 31 inside it and with bezel 29 in front with an insertion play through inlet opening 16 of socket 13. Contact elements 18 elastically slide onto terminals 38 of conductive foil 31 forming electrical connections.

In the same manner, sealing element 41 is placed in receiving area 21 of socket housing 14 and is in close contact with sealing surface 23 under radial stress along the periphery.

Alternatively sealing element 41 could also seal axially against shoulder 22.

Plug-and-socket connection 11 is reversibly secured with the front stop of plug 12 on a bottom 43 formed by a face of contact support 15 and axially limiting insertion area 17, with the end position of plug-and-socket connector 11 being secured by a locking fastening device not illustrated. Thus, both the joint between plug 12 and socket 13 and the lead-through of conductive foil 31 into plug 12 are sealed, and plug-and-socket connector 11 is protected from the penetration of media such as moisture or dust into contact area 36, so that plug-and-socket connector 11 will operate reliably even under rough operating conditions, such as in an automobile.

What is claimed is:

1. An electrical plug-and-socket connector for a conductive foil, comprising:

a plug having a plug housing with a plug cavity and an open end, the conductive foil being guided with a seal through a rear wall of the plug housing to an interior of the plug cavity and ending with metallic terminals mounted along the interior of the plug cavity, a sealing element being externally mounted on the plug housing; and a socket having a socket housing enclosed up to an inlet opening for inserting the plug, contact elements of the socket being mounted in an insertion area and making electrical contact with the metallic terminals of the conductive foil mounted in the plug cavity when the plug is reversibly plugged into the socket housing in a direction of insertion and a plug-and-socket connection is established.

2. The connector according to claim 1, wherein the plug housing includes a top part and a bottom part fit-mounted thereto with a partial insertion of the conductive foil between the top part and the bottom part.

3. The connector according to claim 2, wherein the conductive foil is bonded to the top part, and the top part is bonded to the bottom part by gluing.

4. The connector according to claim 1, wherein the plug housing is formed of a single piece from an injection molded plastic.

5. The connector according to claim 1, wherein a tapering attachment extends from the rear wall of the plug housing and surrounds the conductive foil.

6. The connector according to claim 1, wherein the sealing element includes a radial seal.

7. The connector according to claim 1, wherein the plug housing has an enclosed U-shape.

8. The connector according to claim 1, wherein the contact elements of the socket are U-shaped.

9. The connector according to claim 5, wherein the tapering attachment becomes increasingly flexible after it exits from the rear wall of the plug.

10. The connector according to claim 1, wherein the plug housing is formed of a single piece from a molded curable foam plastic.

11. The connector according to claim 1, wherein the sealing element includes an axial seal.

* * * * *